US006376025B1

(12) United States Patent
Mark

(10) Patent No.: US 6,376,025 B1
(45) Date of Patent: Apr. 23, 2002

(54) METHOD AND SYSTEM FOR APPLYING MINUTE BRISTLES TO A FLOW THROUGH APPLICATOR

(76) Inventor: Phillip Mark, 1255 La Quinta Dr., #214A, Orlando, FL (US) 32809

( * ) Notice: Subject to any disclaimer, the term of this patent is extended or adjusted under 35 U.S.C. 154(b) by 0 days.

(21) Appl. No.: 09/661,805

(22) Filed: Sep. 14, 2000

(51) Int. Cl.[7] ..... B05D 1/04; B05D 1/14
(52) U.S. Cl. ..... 427/462; 427/464
(58) Field of Search ..... 433/80; 136/230; 544/400; 428/90, 378; 427/212, 462, 463, 464, 456, 15, 282; 405/266; 106/284.04

(56) References Cited

U.S. PATENT DOCUMENTS 4,054,700 A * 10/1977 Cooper
4,402,992 A * 9/1983 Liebert
4,929,319 A * 5/1990 Dinter et al.
6,059,570 A * 5/2000 Dragan et al.

* cited by examiner

*Primary Examiner*—Fred J. Parker
(74) *Attorney, Agent, or Firm*—Eric P. Schellin

(57) ABSTRACT

A method for applying flock to the end of a tube which is to be used as a flow through applicator. An external end portion of the tube is coated with an adhesive, air is intermittently blown through the tube to keep the tube clear of unwanted adhesive. The end of the tube coated will the said uncured adhesive in then subjected to an application of flock under the aegis of electrostatic attraction while air is intermittently blow through the tube to thereby keep the tube essentially clear of flock. The tube carrying the flock is subjected to a heat cure. The tube may be of metal or a plastic. When the latter the end portion of the tube is subjected to a preliminary corona discharge whereby to active its service to increase the adhesive to the adhesive coating in a known manner.

1 Claim, 3 Drawing Sheets

METHOD AND SYSTEM FOR APPLYING MINUTE BRISTLES TO A FLOW THROUGH APPLICATOR

BACKGROUND OF THE INVENTION

It has been found effacious to apply small quantities of a medicament in a liquid to surface such as teeth. Such devices are exemplified by the teachings of William B. Dragan in such U.S. Pat. as Nos. 3,900,954 and 6,059,570.

Additionally, such teachings also can be found in such U.S. Pat. Nos. 5,246,371; 5,286,257 and 5,816,804 all to Dan E. Fischer.

The teachings of said patentees are incorporated herein in their entirety by reference.

As flocking under the aegis of electrostatic attraction is a feature of the present invention, attention is directed to U.S. Pat. No. 4,687,257 to Stem who teaches a method of making brushes wherein an elongated member is first softened to provide an adherent surface and is then coated with very small bristles under the influence of electrostatic attraction. This patent is also incorporated herein in its entirety by reference.

Finally, a number of adhesive come to mind with regard to flocking of articles. The teachings in U.S. Pat. No. 3,551,179 to Moses et al exemplifies such applicable adhesives. This patent is incorporated herein in its entirety by reference.

Electrostatic flocking of the end of a tube can be found in U.S. Pat. No. 5,490,737 to Gueret which is incorporated herein in its entirety by reference.

The present invention deals with a problem not heretofore been solved, i,e. the flocking of a tube to produce a controlled orifice opening of the tube in a predictable manner.

SUMMARY OF THE INVENTION

The present invention desirably results in a diminutive flow through nozzle tip that has at its delivery end a group of the minute bristles composed of a flock of fibers. The ends of the fibers are secured to an adhesive to permanently secure the flock in place.

The method includes activating the nozzle tip by treatment with a corona discharge when the nozzle tip is of plastic as opposed to a metal tube. In either case the nozzle tip is coated at an end portion with an adhesive which is hardenable by an additional component and/or by heat curing. The nozzle tip has air blown through intermittently during the adhesive coating process to keep the control of the amount of adhesive that can penetrate the nozzle, especially when the coating process is achieved by dipping the end of the nozzle tip directly into the adhesive. The adhesively coated nozzle tip is flocked with minute fibers under the aegis of electrostatic attraction whereby the flock fibers stick to the adhesive. Air is intermittently blown through the nozzle tip to keep the fibers from encroaching on the orifice of the nozzle tip.

Thereafter the flocked nozzle tip is transported to a heating zone where adhesive is hardened, i.e, cured.

DETAILED DESCRIPTION OF THE PREFERRED EMBODIMENTS

Figure 1:
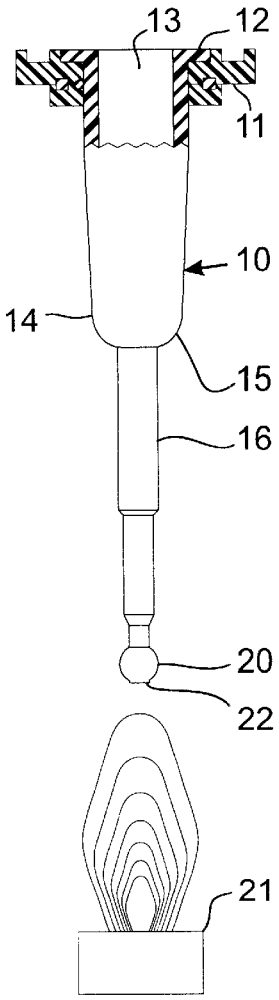
FIG. 1 is a side elevation view shown partly in section showing the nozzle tip being treated to a corona discharge.

The drawings depict a tubular nozzle tip 10 which in the drawings is depicted in an enlarged fashion. In FIG. 1 the tubular nozzle tip 10 is mounted in a fixture 1 1, which may in fact be structured so that it can carry a plurality of tubular nozzle tips 10, generally in a row although it is contemplated that it can comprise a plurality of rows.

The tubular nozzle tip 10 is shown to have a base flange portion 12 which extends outwardly radially A bore 13 extends through the flange 12. The tubular nozzle tip 11 extends distally from the flange 12 in a tube portion 14.

The tube portion 14 terminates in an inwardly directed shoulder portion 15 to a narrower tubular section 16 which extends further distally.

The tube portion 14 and base flange portion 12 is preferably constructed of a thermoplastic material such as nylon, polyethylene or polypropylene.

The tubular section 16 and the remainder of the distally extending tube may be constructed integrally with respect to the tubular portion 14. In such instances it is contemplated that the distal end terminate is a ball 20 having a bore therethrough which is a continuum of the bore of the nozzle tip terminating in an orifice 22.

Figure 1A:
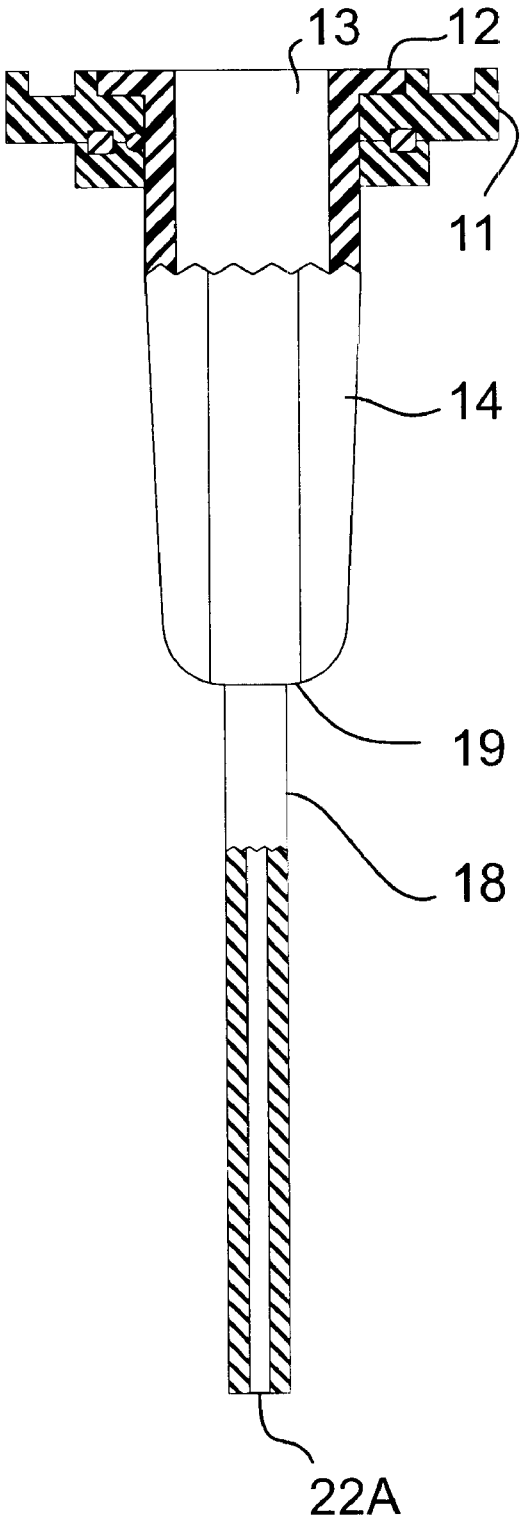
FIG. 1A is a side elevation view shown partly in section showing another embodiment of a nozzle tip.

It is also contemplated that the tube portion 14 terminate at the shoulder 15 exposing thereby an opening into which metal tube is inserted which is fitted into the opening as by a bushing for friction fitting into the opening. Attention is directed to FIG. 1A for such a second embodiment. In this embodiment, the distal end tube 18 is metal and is fitted into tube portion 14 by means of bushing 19. In this embodiment, but not confined thereto tube portion 14 is fitted with a plurality of radially extending fins 15 designed to provide grasping surfaces when manually placed in the luer of a syringe or removed therefrom.

In still another embodiment it is contemplated that the tube portion be injection molded about the end portion of the metal tube.

The bores of the tubes 16 and/or 18 are between 16 to 30 guage.

When the nozzle tip is entirely of thermoplastic, ball 20 requires a surface treatment. It is well known that such a ball may be subjected to corona discharge to thereby increase the receptivity to the adhesive. In FIG. 1, therefore it is schematically shown that the ball is treated to corona discharge by corona discharge apparatus 21.

Figure 2:
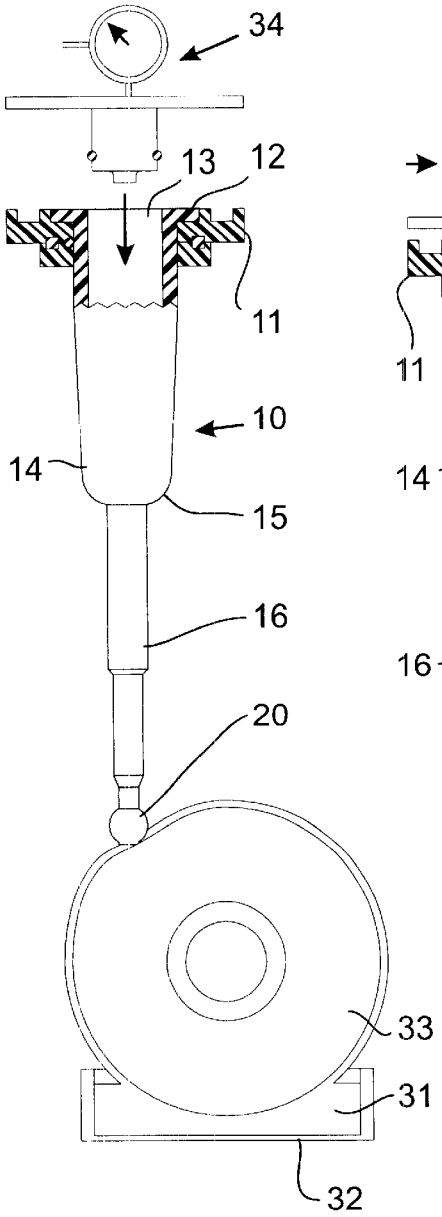
FIG. 2 is a similar elevation as FIG. 1 showing the application of a liquid adhesive.
Figure 3:
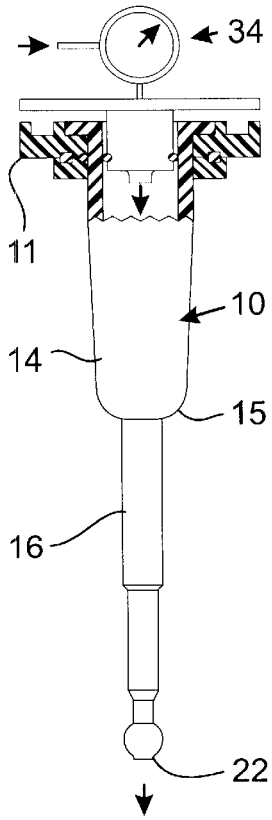
FIG. 3 is a similar elevation as FIG. 1 wherein schematically means is applied for delivering air under pressure.

In FIG. 2 the next step of the method is shown depicting application of a conventional epoxy resin containing a hardener. The liquid adhesive 31 is contained in a reservoir 32 into which a foam type roller 33 rotates and dips. As the roller 33 is rotated it applies the adhesive externally to the ball 20 of the nozzle tip by a wiping action. At the same time in FIG. 2, an air pressure assembly 34 is inserted into the bore 13 by means of which air is applied to the nozzle tip which flows through the nozzle tip out of opening 22.

When a fixture is employed that supports a plurality of nozzles the entire support fixture is placed into a plenum chamber which is pressurized with air and, thereby, all of the plurality of nozzle tips have air flowing therethrough in a uniform manner.

The subsequent step resides in applying flock to the ball 20 which has now been suitably coated with adhesive. The flock consists of minute strands of nylon, although, it is contemplated that other fibers may be employed, such as cotton, rayon and polyester.

Figure 4:
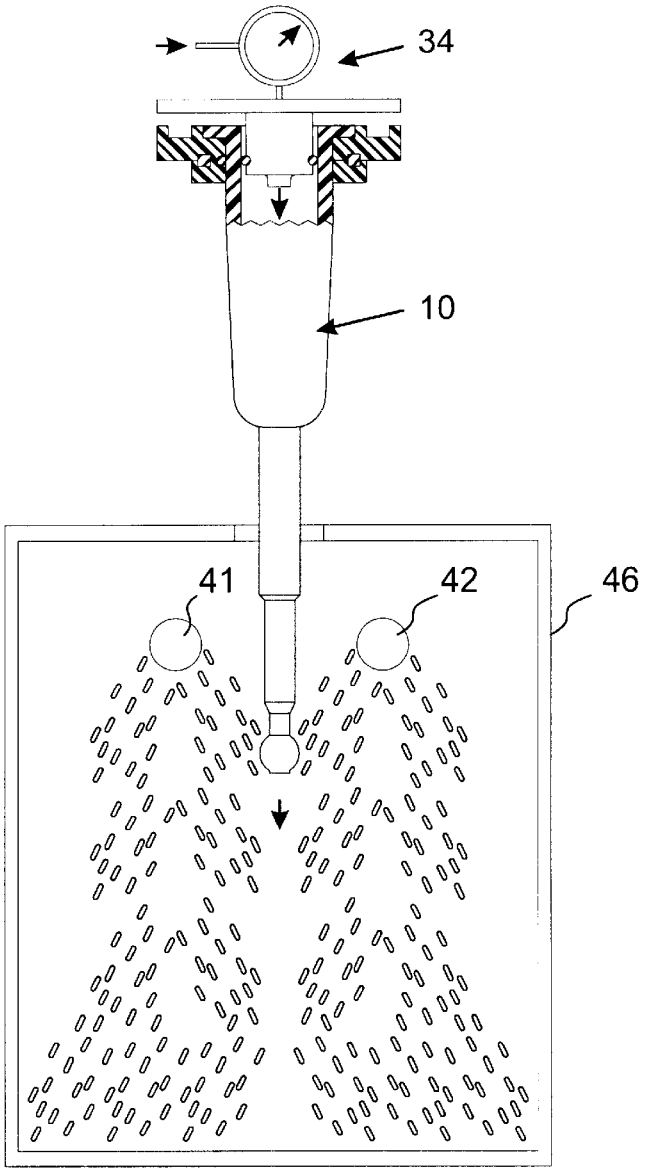
FIG. 4 is a similar elevation as FIG. 1 wherein the nozzle tip is in a chamber in which flock is applied to the nozzle tip.

FIG. 4 depicts flocking box 40 into which the nozzle tip is inserted. The flocking box is provided with electrostatic means consisting of grounding rods 41 and 42 for applying in a well known manner a flood of flock thereby creating a swarm of fiber particles some of which then strike the adhesively coated ball 20 of the nozzle tip and will adhere thereto in a manner that they assume a layer of fibers thereon, many of which will abut preferably perpendicularly to the ball. It is pointed out that air flow through orifice 22 of the nozzle tip is continued to thereby keep the orifice essentially free of the now being applied fibers.

It has been found to be most propitious to maintain the orifice 22 free of fibers by pulsing the air rather than subjecting the nozzle tip to a continuous flow.

Figure 5:
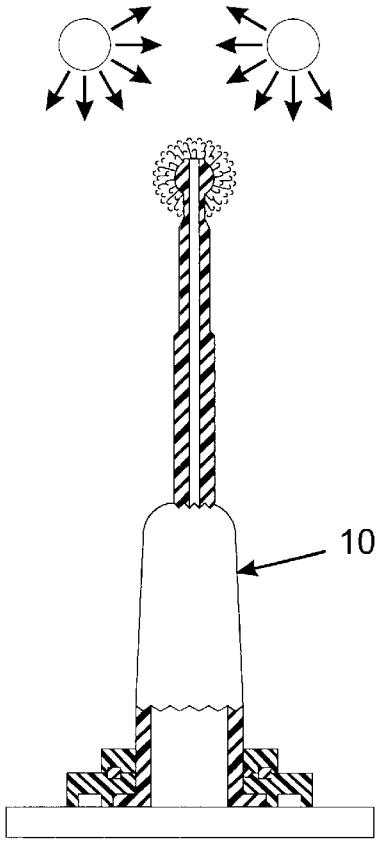
FIG. 5 is a side elevation view shown partly in section wherein the nozzle tip is subjected to heat to cure the adhesive.

In the final step of the process, attention is directed to FIG. 5 which depicts the nozzle tip being subjected to a heat cure of the adhesive by means of conventional infra red lamps, for instance. It is also contemplated that an array of the nozzle tips may be moved into an oven wherein the nozzles undergo a heat treatment.

It is contemplated that the operation may be in a continuous assembly line. In such an instance a plurality of nozzle tips are assembled on a series fixtures to form arrays of nozzle tips. The fixtures carrying such arrays are mounted on a moving endless conveyer means and indexed through the adhesive station, to an air pressurization station followed by the flocking application station and finally to a heat curing station. The nozzle tips are then unloaded from the fixtures.

When the tube 16 is plastic and the ball 20 thereof is flocked, the ball will have a rounded surface providing an excellent brush whereby there is good distribution of the to-be deposited liquid on a to-be treated surface. The nozzle tip can then indeed be used as a brush for painting an area.

When the tube 18 is of a metal, the end orifice 22A acts as a drop collector to a degree dependent upon the degree of viscosity of the to-be applied liquid. A metal tube 18 possesses another feature in that it can be bent anywhere along its length to thereby successfully adapt the nozzle to fit into hard to reach places for application of the to-be-applied fluid containing a medicament.

It will be appreciated that there are a considerable number of variables that control the making of the resultant brush so that no single parameter is most controlling.

By controlling the viscosity of the adhesive the amount of flock can be controlled. In addition the flock size is also selected as a function of the number of flock fibers that will adhere. The fibers may range from 1.5 to 4 Denier. The length selected may range from 0.020 to 0.060 inches in length.

The blow through of air has been found as a controlling factor of the number of flock fibers that extend on the orifice of the nozzle tip to thereby interfere in the flow through characteristics of the carrying capacity of any liquid that is to be applied by the flow through applicator. For instance, in some cases it is desirable that the orifice of the nozzle tip be completely free of flock fibers to permit maximum flow through. In other situations, as when drop of the to be applied liquid is to be carried intact by the applicator it may be desirable to have many flock fibers obstructing the orifice.

Of course, the viscosity of the to-be-applied liquid will also be a factor in the distribution of the liquid and therefore, the need for flock obduration.

It is also important to consider the size of the bore of the nozzle tip. This latter dimension will also be a factor in the degree of obduration necessary at the resultant nozzle tip.

The present invention may be embodied in other specific forms without departing from its spirit or essential characteristics. The described embodiments are to be considered in all respects only as illustrative and not restrictive. The scope of the invention is, therefor indicated by the appended claims rather than by the foregoing description. All changes which come within the meaning and range of equivalency of the claims are to be embraced within their scope.

What is claimed is:

1. A method for applying flock to the distal end portion of a tip of a nozzle, said tip terminating in an orifice, comprising:

coating the tip of the nozzle with a liquid epoxy adhesive containing a hardener therefor;

pulsing air through the orifice of the tip while applying the coating of said adhesive;

providing an environment of flock of a polymer olefin, having a denier of between 1.5–4 and a length of between 0.020 to 0.60 inches, about the tip of said adhesively coated tip;

providing electrostatic attraction between said flock and said adhesively coated tip whereby said tip is coated with flock;

continuing to pulse air through said orifice to clear said orifice of unwanted flock and control the number of flock fibers that extend on said orifice;

thereafter heating at least said tip to cure the epoxy adhesive to thereby adhesively secure said flock to said tip.

* * * * *